US012741307B2

(12) United States Patent
Fujii

(10) Patent No.: US 12,741,307 B2
(45) Date of Patent: Sep. 22, 2026

(54) PRESS FORMING METHOD

(71) Applicant: JFE STEEL CORPORATION, Tokyo (JP)

(72) Inventor: Yusuke Fujii, Tokyo (JP)

(73) Assignee: JFE STEEL CORPORATION, Tokyo (JP)

( * ) Notice: Subject to any disclaimer, the term of this patent is extended or adjusted under 35 U.S.C. 154(b) by 249 days.

(21) Appl. No.: 18/269,319

(22) PCT Filed: Aug. 5, 2021

(86) PCT No.: PCT/JP2021/029184
§ 371 (c)(1),
(2) Date: Jun. 23, 2023

(87) PCT Pub. No.: WO2022/137630
PCT Pub. Date: Jun. 30, 2022

(65) Prior Publication Data

US 2024/0066581 A1 Feb. 29, 2024

(30) Foreign Application Priority Data

Dec. 24, 2020 (JP) ..... 2020-214439

(51) Int. Cl.
*B21D 22/24* (2006.01)
*B21D 22/26* (2006.01)
*B21D 53/88* (2006.01)

(52) U.S. Cl.
CPC ..... *B21D 22/24* (2013.01); *B21D 22/26* (2013.01); *B21D 53/88* (2013.01)

(58) Field of Classification Search
CPC ..... B21D 22/20; B21D 22/24; B21D 22/26; B21D 53/88
See application file for complete search history.

(56) References Cited

U.S. PATENT DOCUMENTS 11,712,729 B2 8/2023 Miyake et al.
2016/0375477 A1* 12/2016 Tanaka ..... B21D 5/01 72/356

(Continued)

FOREIGN PATENT DOCUMENTS

CN 106463741 A 2/2017
CN 111836689 A 10/2020

(Continued)

OTHER PUBLICATIONS

Oct. 26, 2021 International Search Report issued in International Patent Application No. PCT/JP2021/029184.

(Continued)

*Primary Examiner* — Teresa M Ekiert
(74) *Attorney, Agent, or Firm* — Oliff PLC

(57) ABSTRACT

A press forming method for suppressing wall camber of a side wall portion due to springback of a press-formed product including a top portion, the side wall portion and a flange portion includes: a first forming step of press-forming a preformed part including a flange portion having height continuously changed in an axial direction to have a concave shape, a convex shape or a concavo-convex shape more largely than a target shape of the press-formed product in a height direction to provide a height difference; and a second forming step of press-forming the preformed part into the press-formed product having the target shape to reduce the height difference of the flange portion of the preformed part.

6 Claims, 8 Drawing Sheets

(a) PREFORMED PART (b) PRESS-FORMED PRODUCT

(56) References Cited

U.S. PATENT DOCUMENTS

| | | | | |
|---|---|---|---|---|
| 2017/0194655 | A1 | 7/2017 | Yoshida | |
| 2017/0291208 | A1 | 10/2017 | Nishimura et al. | |
| 2019/0030583 | A1* | 1/2019 | Nishimura | B21D 22/22 |
| 2020/0238355 | A1* | 7/2020 | Tobita | B21D 22/26 |
| 2020/0398328 | A1 | 12/2020 | Miyake et al. | |

FOREIGN PATENT DOCUMENTS

| | | | |
|---|---|---|---|
| JP | S60-6223 | A | 1/1985 |
| JP | 2006-281312 | A | 10/2006 |
| JP | 2009-255117 | A | 11/2009 |
| JP | 2011-206789 | A | 10/2011 |
| JP | 2017-42791 | A | 3/2017 |
| JP | 6500927 | B2 | 4/2019 |
| JP | 6551637 | B1 | 7/2019 |
| JP | 2020-185591 | A | 11/2020 |
| KR | 10-2018-0105216 | A | 9/2018 |
| KR | 10-2020-0110435 | A | 9/2020 |
| WO | 2016/051765 | A1 | 4/2016 |

OTHER PUBLICATIONS

May 6, 2024 Extended Search Report issued in European Patent Application No. 21909790.4.

Wu, Xin-Tao et al. "Bending and Springback of High-strength Dual Phase Steel DP800", Journal of Netshape Forming Engineering, China, vol. 8 No. 4, Jul. 10, 2016.

Jun. 18, 2025 Office Action issued in Chinese Patent Application No. 202180086391.1.

Dec. 26, 2025 Office Action issued in Chinese Patent Application No. 202180086391.1. [English-language Concise Statement of Relevance attached hereto.].

* cited by examiner (a) PREFORMED PART (b) PRESS-FORMED PRODUCT (a) PERSPECTIVE VIEW (b) SECTIONAL VIEW (a) FIRST PROCESS (DEEP DRAWING) (b) SECOND PROCESS (CRASH FORMING)

(a) FLANGE PORTION CURVED IN CONCAVE SHAPE (b) FLANGE PORTION CURVED IN CONVEX SHAPE (a) PREFORMED PART (b) PRESS-FORMED PRODUCT

PRESS FORMING METHOD

FIELD

The present invention relates to a press forming method, and more particularly to a press forming method for suppressing wall camber of a side wall portion due to springback of a press-formed product including a top portion, a side wall portion, and a flange portion.

BACKGROUND

Press forming is a manufacturing method that can manufacture metal parts at low cost in a short time and is used for manufacturing many automotive parts. In recent years, in order to achieve both of collision safety of an automobile and weight reduction of automotive body, a high-strength metal sheet (for example, a high-strength steel sheet) is used for automotive parts.

One of main problems in press-forming the high-strength metal sheet is deterioration in dimensional accuracy of a press-formed product due to springback. A phenomenon in which residual stress generated in a press-formed product when a metal sheet is deformed by press forming using a tool of press forming becomes a driving force and the press-formed product die-released from the tool of press forming is about to return to the shape of the metal sheet before the press forming like a spring is referred to as springback.

In a press-formed product 1 including a top portion 3, a side wall portion 5, and a flange portion 7 as illustrated in FIG. 2 as an example, in some case, springback called wall camber occurs in which the side wall portion 5 is deformed into a warped shape as illustrated in FIG. 3 after being press-formed and die-released.

A mechanism in which wall camber occurs in the side wall portion 5 of the press-formed product 1 is explained with reference to a schematic diagram illustrated in FIG. 4.

In a process for press-forming (deep drawing) a metal sheet into the press-formed product 1 using a tool of press forming including a punch, a die, and a blank holder, first, the metal sheet is bent at a die shoulder of a die and tensile stress is generated on the outer side bending of a bent portion and compressive stress is generated on the inner side of the bending of the bent portion. Then, when the die relatively moves up to the bottom dead center to the punch side, the bending of the portion bent at the die shoulder is unbent flat by the punch and the die to become the unbending side wall portion 5 (FIG. 4(*a*)). Therefore, in the side wall portion 5 at the forming bottom dead center, compressive stress is generated on a side equivalent to the bending outer side of the portion bent at the die shoulder and tensile stress is generated on the side equivalent to the bending inner side. As a result, a large residual stress difference occurs between the front surface and the rear surface of the side wall portion 5.

Subsequently, when the press-formed product 1 press-formed to the forming bottom dead center is removed (die-released) from the tool of press forming, springback is generated using the residual stress generated during the press forming as a driving force. At this time, whereas the front surface of the side wall portion 5 on which the tensile stress is generated is about to shrink, the rear surface of the side wall portion 5 on which the compressive stress is generated is about to expand. Therefore, curved wall camber illustrated in FIG. 4(*b*) occurs.

Here, since the residual stress generated in the press-formed product 1 is larger when press-forming is performed using a high-strength metal sheet, the wall camber of the side wall portion 5 due to the springback is larger. Therefore, it is more difficult to keep the shape of the press-formed product after springback within a prescribed dimension as the metal sheet has high strength. Therefore, a technique for suppressing wall camber of the side wall portion is important.

As measures against such wall camber of the side wall portion, several techniques have been proposed so far. For example, Patent Literature 1 discloses a method in which a bead that restrains inflow of materials flowing from a flange portion to a side wall portion in a forming process is provided in the flange portion to apply a large tensile force to the entire side wall portion during press forming to eliminate camber of the side wall portion.

Contrary to the method disclosed in Patent Literature 1, Patent Literature 2 discloses a method of reducing a difference in stress between the front and rear of a side wall portion and reducing side wall camber by applying compressive stress to the formed side wall portion as a whole.

Further, as a method of reducing the wall camber of the side wall portion, besides these methods of applying tensile stress or compressive stress to the side wall portion as a whole, for example, Patent Literature 3 discloses a method of increasing stiffness of a side wall portion and reducing wall camber by forming a vertical bead of a concave groove in a press forming direction on a side wall portion of a press-formed product in a process of press-forming the press-formed product having a convex cross section or a concave cross section.

CITATION LIST

Patent Literature

Patent Literature 1: JP 2006-281312 A
Patent Literature 2: Japanese Patent No. 6500927
Patent Literature 3: JP 60-6223 A

SUMMARY

Technical Problem

In the method disclosed in Patent Literature 1, compared with the case in which no bead is provided in the flange portion, the side wall portion is further extended in the press forming process and fracture sometimes occurs in the side wall portion. The bead provided on the flange portion is unnecessary as a press-formed product having a product shape even if the bead is necessary to reduce the wall camber of the side wall portion. Therefore, since it is necessary to cut off the bead in a post-process after the bead is provided and the press-formed product is press-formed, a yield is lowered and causes a problem.

In the method disclosed in Patent Literature 2, since the structure of the tool of press forming becomes complicated to apply the compressive stress to the formed side wall portion and manufacturing cost of the tool of press forming increases and, further, the end portion of the metal sheet collides with the surface of the tool of press forming, the tool of press forming is easily worn and causes a problem.

Further, in the method disclosed in Patent Literature 3, in some case, the vertical bead cannot be formed on the side wall portion because of the shape of a component to be formed and it is difficult to apply the method.

The present invention has been made in view of the above problems, and an object of the present invention is to provide a press forming method for suppressing fracture in a press forming process and suppressing wall camber of a side wall portion without reducing a yield.

Solution to Problem

A press forming method according to the present invention suppresses wall camber of a side wall portion due to springback of a press-formed product including a top portion, the side wall portion and a flange portion, and includes: a first forming step of press-forming a preformed part including a flange portion having height continuously changed in an axial direction to have a concave shape, a convex shape or a concavo-convex shape more largely than a target shape of the press-formed product in a height direction to provide a height difference; and a second forming step of press-forming the preformed part into the press-formed product having the target shape to reduce the height difference of the flange portion of the preformed part.

The flange portion in the first forming step may have a shape curved in a convex shape or a concave shape in the height direction in the axial direction.

The flange portion in the first forming step may be formed in a convex shape or a concave shape in the height direction in the axial direction by a plurality of planer portions disposed in the axial direction and a bent portion coupling the adjacent planer portions.

A blank to be subjected to the press-forming of the press-formed product may be a metal sheet having tensile strength of a 440 MPa-grade to a 1800 MPa-grade.

Advantageous Effects of Invention

According to the present invention, it is possible to reduce the difference in residual stress between the front and rear surfaces by applying tensile stress and compressive stress that cause plastic deformation to the side wall portion of the press-formed product, prevent fracture of the metal sheet, press-form the press-formed product without reducing a yield, and suppress wall camber of the side wall portion due to springback.

DESCRIPTION OF EMBODIMENT

Figure 1:
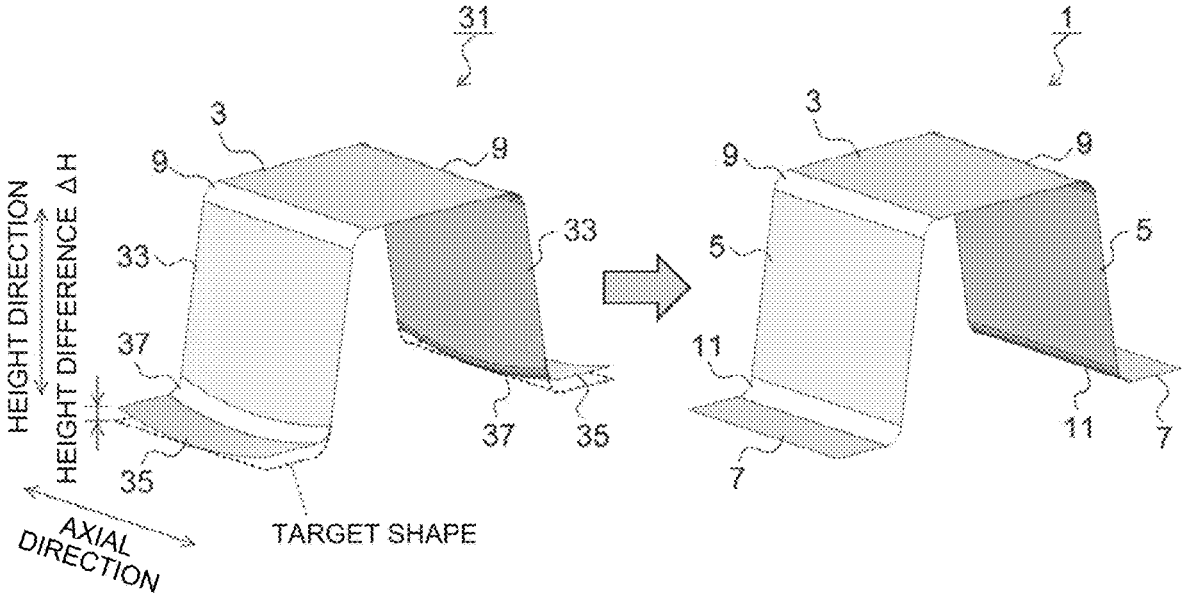
FIG. 1 is a diagram for explaining one aspect of a press forming method according to an embodiment of the present invention.

Before a press forming method according to an embodiment of the present invention is explained, circumstances leading to the present invention are explained. Note that, in the following explanation, substantially the same or corresponding parts are denoted by the same reference numerals and signs.

Circumstances Leading to the Invention

Figure 2:
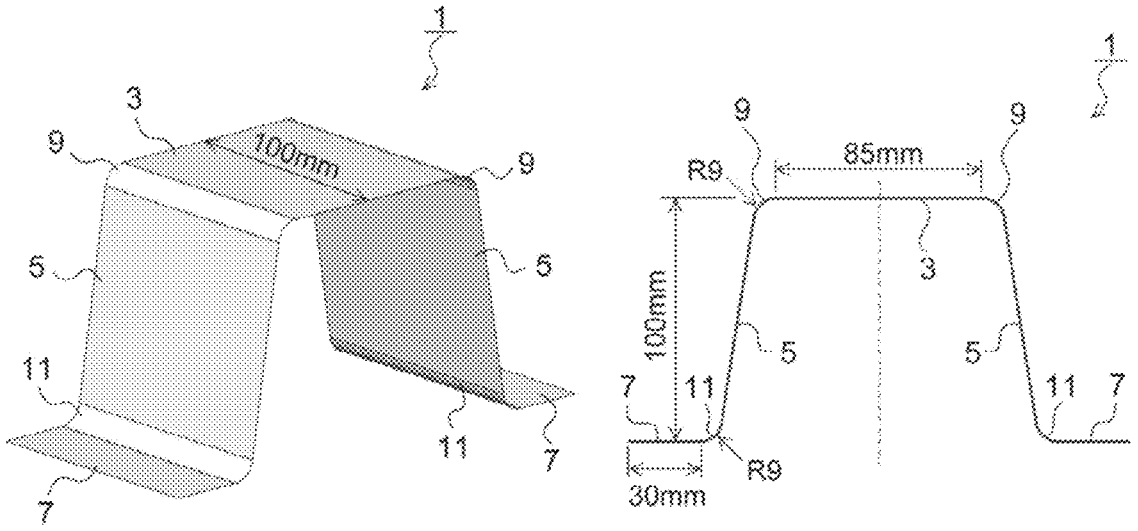
FIG. 2 is a diagram illustrating a press-formed product having a hat-type cross-sectional shape to be formed in the embodiment of the present invention and an example 1.
Figure 3:
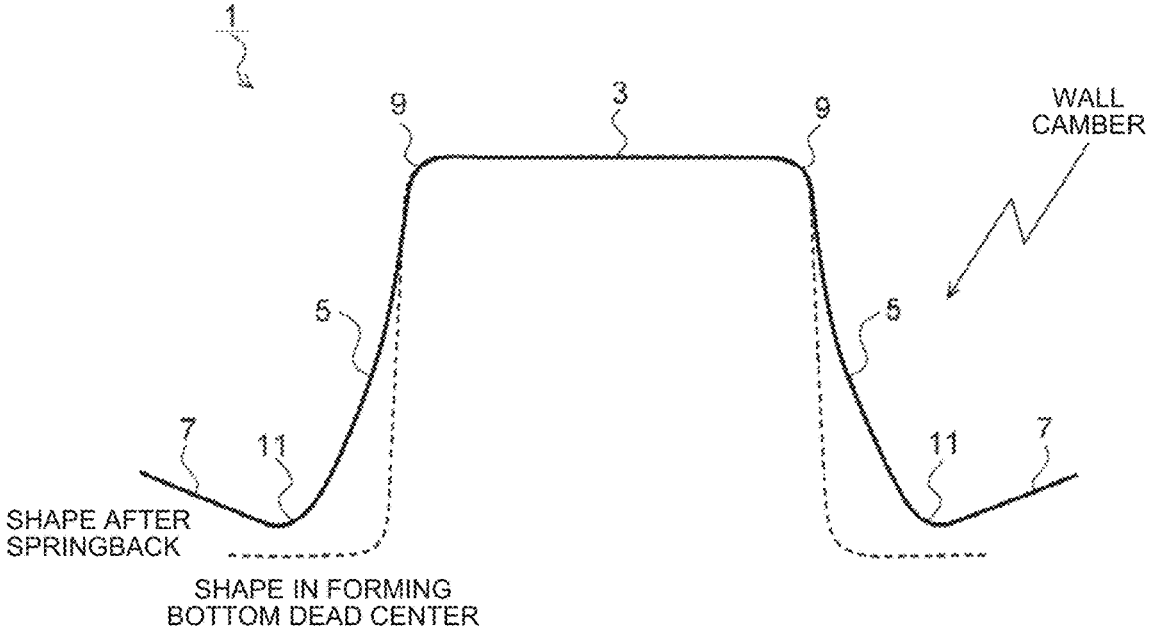
FIG. 3 is a diagram illustrating wall camber of a side wall portion caused by springback of a press-formed product.

As a method for suppressing wall camber of a side wall portion 5 of a press-formed product 1 illustrated in FIG. 2 and FIG. 3, the inventors studied a method of applying tensile stress to the side wall portion 5 without providing a bead in a press forming process like the method disclosed in Patent Literature 1 in order to prevent a metal sheet from being fractured in the press forming process and not to lower a yield.

As illustrated in FIG. 2, the press-formed product 1 to be examined includes a top portion 3, a side wall portion 5, and a flange portion 7. The top portion 3 and the side wall portion 5 are continuous via a punch shoulder ridge 9. The side wall portion 5 and the flange portion 7 are continuous via a die shoulder ridge 11.

Figure 4:
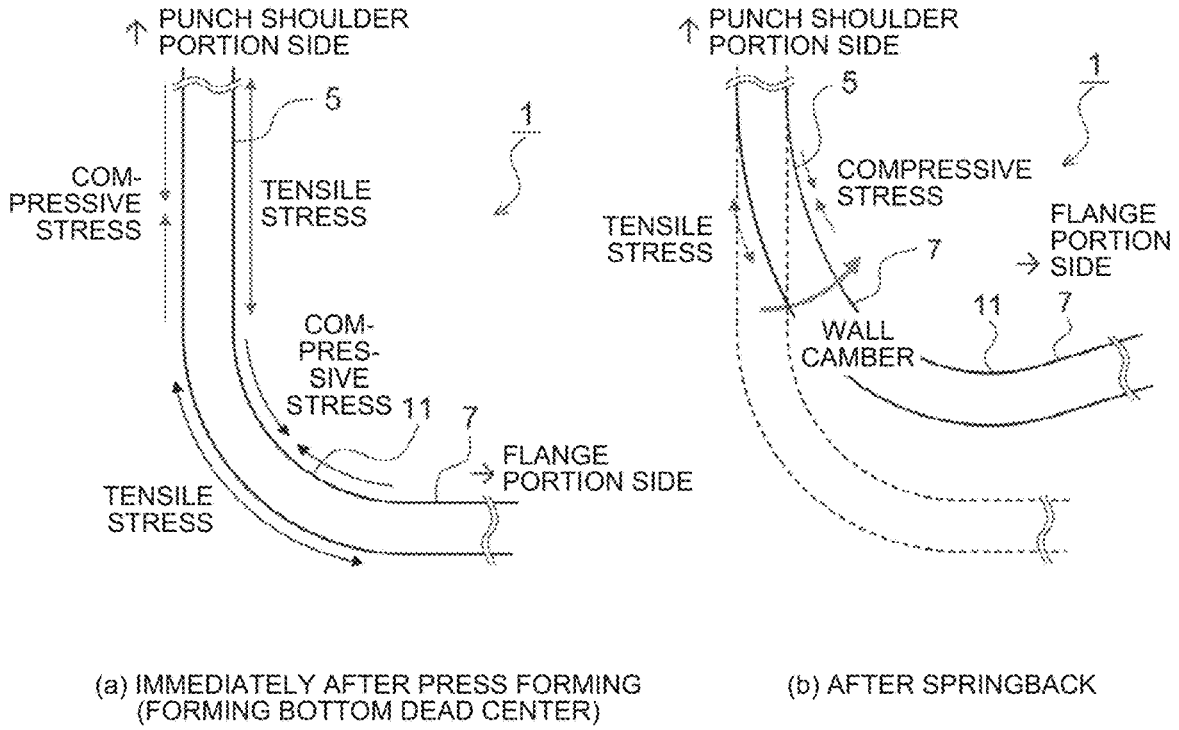
FIG. 4 is a diagram for explaining a mechanism in which wall camber of the side wall portion occurs because of the springback of the press-formed product.

Then, focusing on the fact that the residual stress of the side wall portion 5 is small as illustrated in FIG. 4(*b*) referred to above in the press-formed product 1 after the springback, it has been conceived that, after the springback, the side wall portion 5 can be plastically deformed even if the tensile stress applied to the side wall portion 5 is small and the residual stress difference between the front and rear surfaces of the side wall portion 5 can be reduced.

Figure 5:
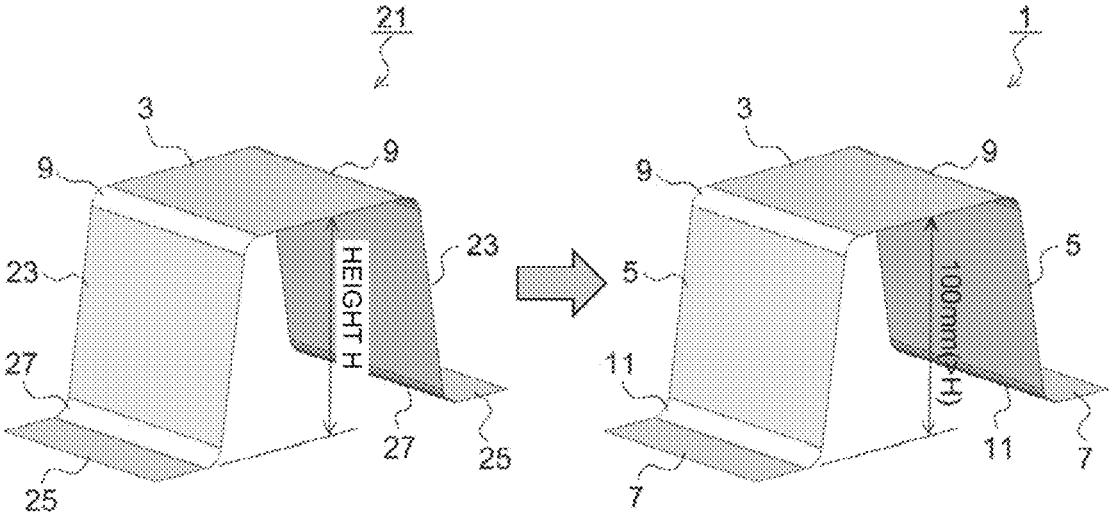
FIG. 5 is a diagram illustrating an example of a preformed part and a press-formed product having a target shape in a conventional method of suppressing wall camber of a side wall portion by applying tensile stress to an entire side wall portion.

Therefore, first, as a method of applying tensile stress to the side wall portion 5 similar to Patent Literature 1, a method of press-forming the press-formed product 1 in two steps as illustrated in FIG. 5 was studied. In this study, a high-strength steel sheet (yield strength: 880 MPa) having a tensile strength of a 1210 MPa-grade was used as a metal sheet, a preformed part 21 was press-formed by deep drawing in a first step and the press-formed product 1 was press-formed by crash forming in a second step.

Various conditions in which height H of the preformed part 21 (see FIG. 5(*a*)) was changed to be lower than the press-formed product 1 were studied. However, even if the height of the preformed part 21 is changed, wall camber of the side wall portion 5 of the press-formed product 1 was unable to be sufficiently suppressed.

Figure 6:
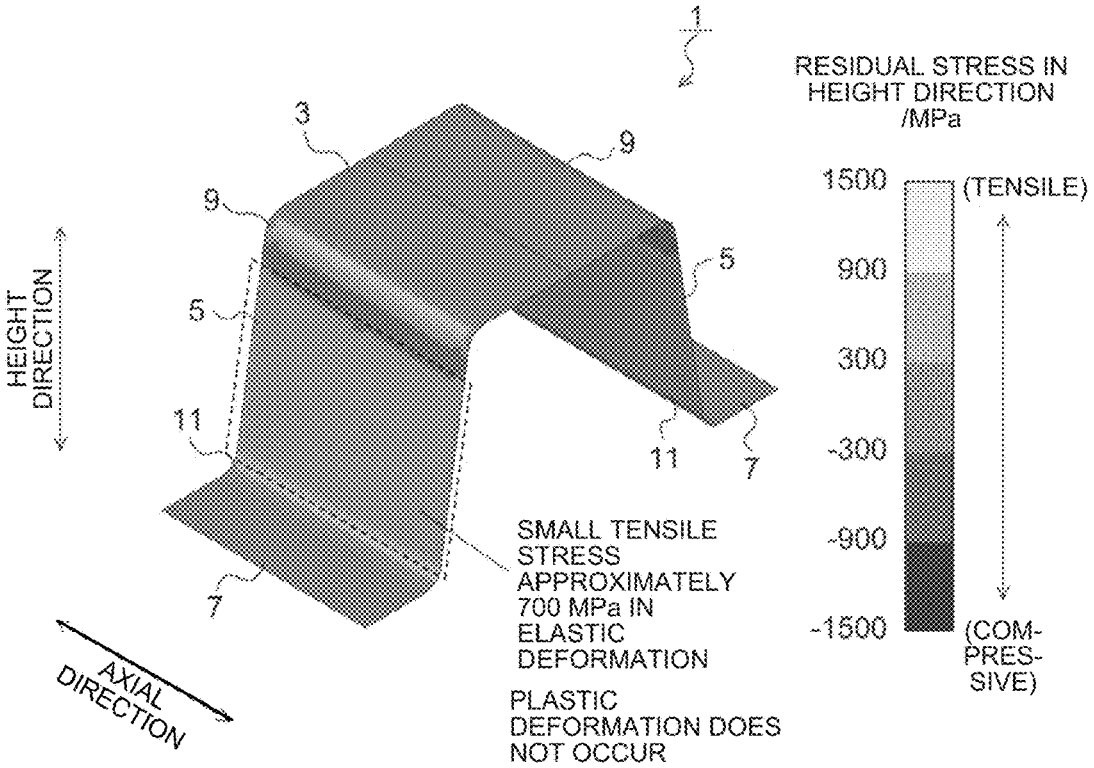
FIG. 6 is a diagram illustrating a distribution of residual stress in a height direction generated in the side wall portion of the press-formed product press-formed into the target shape by the conventional method of applying the tensile stress to the entire side wall portion.

As a result of studying the cause of the above, as illustrated in FIG. 6, it was found that this is because the tensile stress generated in the side wall portion 5 at the time of press-forming the press-formed product 1 in the second step was unable to exceed the yield strength (=880 MPa) of the metal sheet, the side wall portion 5 was unable to be plastically deformed, and the residual stress difference between the front and rear surfaces of the side wall portion 5 was unable to be reduced. In addition, when the press forming in the second step is performed by applying a tensile stress exceeding the yield strength of the metal sheet, the die shoulder ridge 27 of the preformed part 21 is unbent and the shape of the flange portion 7 of the press-formed product 1 cannot be maintained to cause a problem.

Therefore, the inventors further studied a method in which the shape of the flange portion 7 of the press-formed product 1 can be maintained and a tensile stress equal to or higher than the yield strength is applied to the side wall portion 5.

As a result, as illustrated in FIG. 1, the present inventors found that, by forming a flange portion 35 of a preformed part 31 formed in the first step into a shape concavely curved in the height direction in the axial direction and locally lowering the side wall height of a side wall portion 33 of the preformed part 31, tensile stress equal to or higher than the yield strength of the metal sheet can be applied to the side wall portion 5 in the second step and, moreover, wall camber of the side wall portion 5 can be suppressed while maintaining the shape of the flange portion 7 of the press-formed product 1. The present invention has been made based on the study explained above. A specific configuration of the present invention is explained below.

Press Forming Method

The press forming method according to the embodiment of the present invention is, as an example, a press forming method for suppressing wall camber of the side wall portion 5 due to springback of the press-formed product 1 illustrated in FIG. 2 as an example and including a first forming step of press-forming the preformed part 31 illustrated in FIG. 1(*a*) and a second forming step of press-forming the preformed part 31 into the press-formed product 1 having a target shape illustrated in FIG. 1(*b*). The steps are explained below.

First Forming Step

As illustrated in FIG. 1(*a*), the first forming step is a step of press-forming the preformed part 31 including the flange portion 35 having a height continuously changed in the axial direction to have a concave curve larger than the target shape of the press-formed product 1 in the height direction to provide a height difference.

In the present embodiment, as an example, the flange portion 7 of the press-formed product 1 having the target shape is formed in a flat shape. The height difference of the flange portion 35 curved in the concave shape is a difference in a height direction between an axial direction tip in the highest position in the height direction and an axial direction center in the lowest position in the height direction in the flange portion 35.

In the first forming step, the top portion 3 and the punch shoulder ridge 9 are respectively formed into the same shape as the target shape of the press-formed product 1.

Second Forming Step

As illustrated in FIG. 1(*b*), the second forming step is a step of press-forming the preformed part 31 into the press-formed product 1 having the target shape to reduce the height difference of the flange portion 35 of the preformed part 31 press-formed in the first forming step.

Action Effects

Action effects of the press forming method according to the embodiment of the present invention are explained with reference to, as an example, a case in which, as illustrated in FIG. 1, the flange portion 35 that is curved in the concave shape in the height direction in the axial direction (at a curvature radius of 200 mm in the present embodiment) is formed in the first forming step and the preformed part 31 is press-formed into the press-formed product 1 having the target shape to reduce the height difference of the flange portion 35 in the second forming step.

Figure 7:
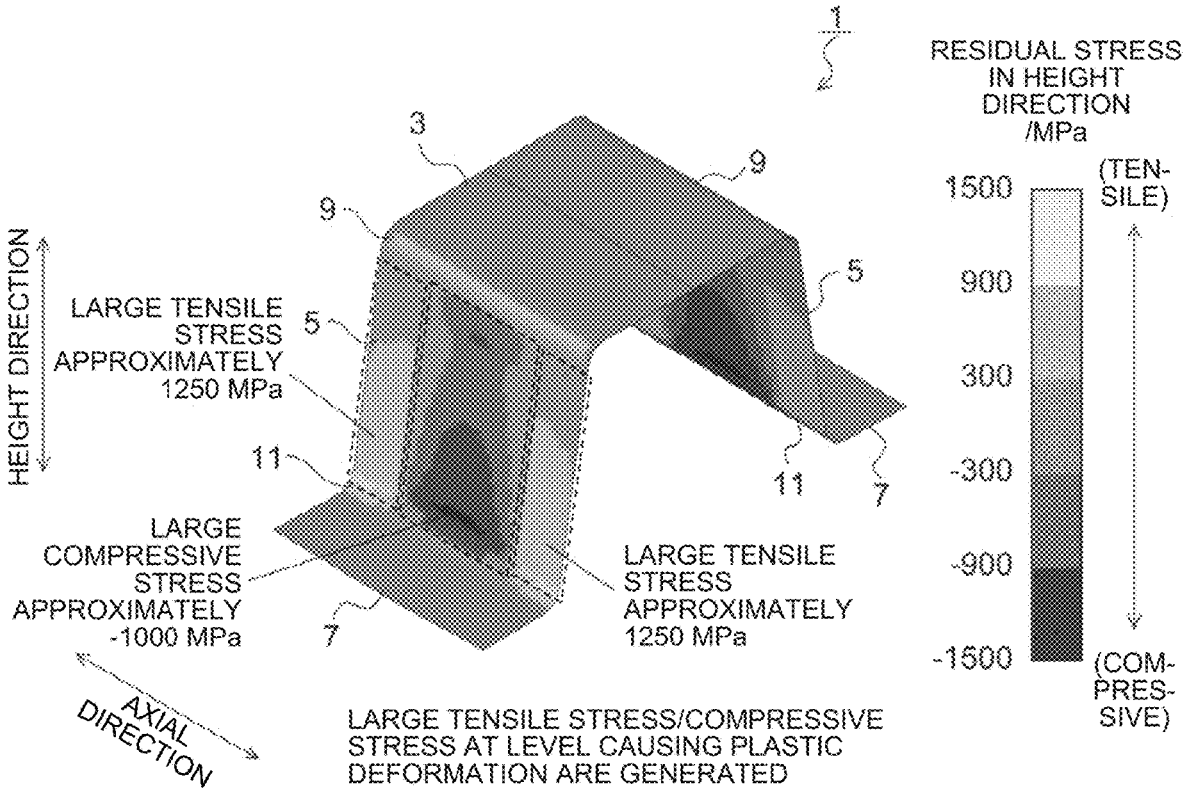
FIG. 7 is a diagram illustrating a distribution of residual stress in a height direction generated in a side wall portion of a press-formed product having a target shape press-formed by the press forming method according to the embodiment of the present invention.

FIG. 7 illustrates a distribution of residual stress in the height direction of the press-formed product 1 in the forming bottom dead center in the second forming step. The flange portion 35 and a die shoulder ridge 37 formed in the first forming step are unbent and deformed to reduce the curvature of the curve in the axial direction in the second forming step.

At this time, since flow stress for unbending and deforming the flange portion 35 and the die shoulder ridge 37 is intensively generated on both end sides in the axial direction, tensile stress (approximately 1250 MPa in the present embodiment) for causing plastic deformation exceeding yield strength (=880 MPa) of the metal sheet is applied to the side wall portions 5 on both end sides in the axial direction of the press-formed product 1. In contrast, in the side wall portion 5 in the axial direction center of the press-formed product 1, compressive stress (approximately −1000 MPa in the present embodiment) having substantially the same degree of an absolute value is generated as a counterforce of tensile stress generated on both the end sides in the axial direction is generated.

As described above, in the second forming step, the tensile stress and the compressive stress for causing plastic deformation are generated in the side wall portion 5. The residual stress difference between the front and rear surfaces of the side wall portion 5 can be reduced. As a result, wall camber of the side wall portion 5 due to springback after the press-formed product 1 is die-released can be suppressed.

Figure 8:
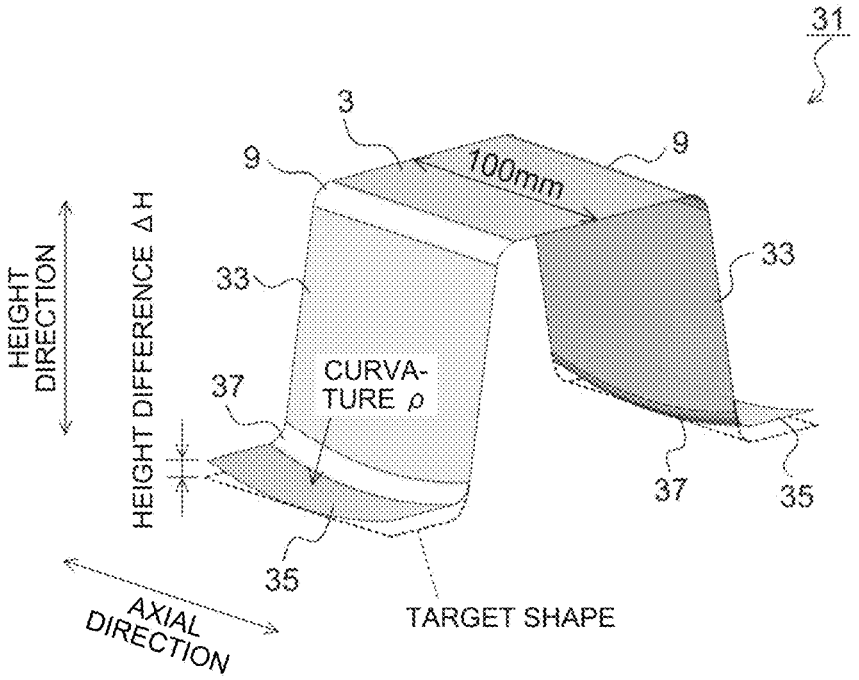
FIG. 8 is a diagram illustrating a shape of a flange portion of a preformed part in another aspect of the press forming method according to the embodiment of the present invention and the example 1.
Figure 8:
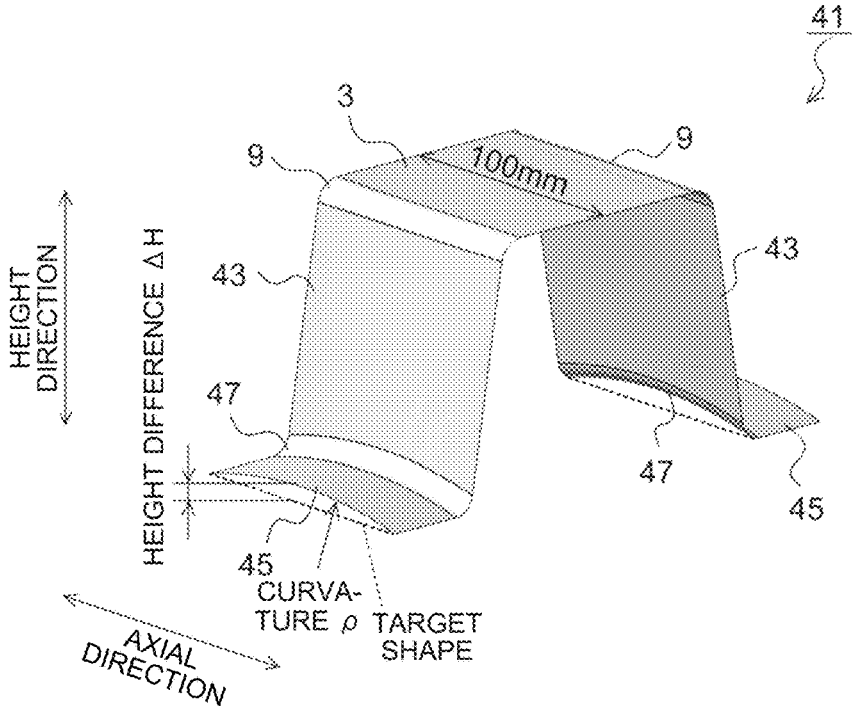

In the above explanation, in the first forming step, the flange portion 35, the height of which changes in the axial direction, curved in the concave shape as illustrated in FIG. 8(*a*) is formed. However, as another aspect of the present embodiment, as illustrated in FIG. 8(*b*) as an example, in the first forming step, a flange portion 45 having height continuously changed in the axial direction to be curved in the convex shape more largely than the target shape of the press-formed product 1 in the height direction to provide a height difference may be formed.

Figure 9:
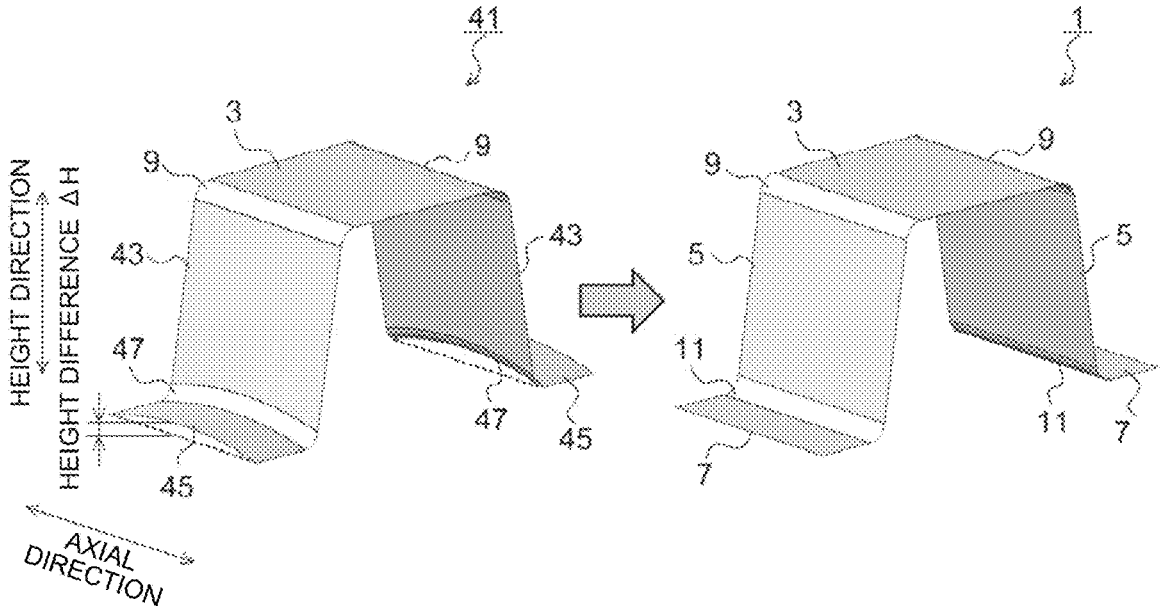
FIG. 9 is a diagram for explaining another aspect of the press forming method according to the embodiment of the present invention.

In this case, in the second forming step, as illustrated in FIG. 9, a preformed part 41 is press-formed into the press-formed product 1 having the target shape to reduce the height difference of the flange portion 45 of the preformed part 41. Here, the height difference of the flange portion 45 curved in the convex shape is a difference in the height direction between the axial direction center in the highest position in the height direction in the flange portion 45 and the axial direction tip in the lowest position in the height direction position.

Figure 10:
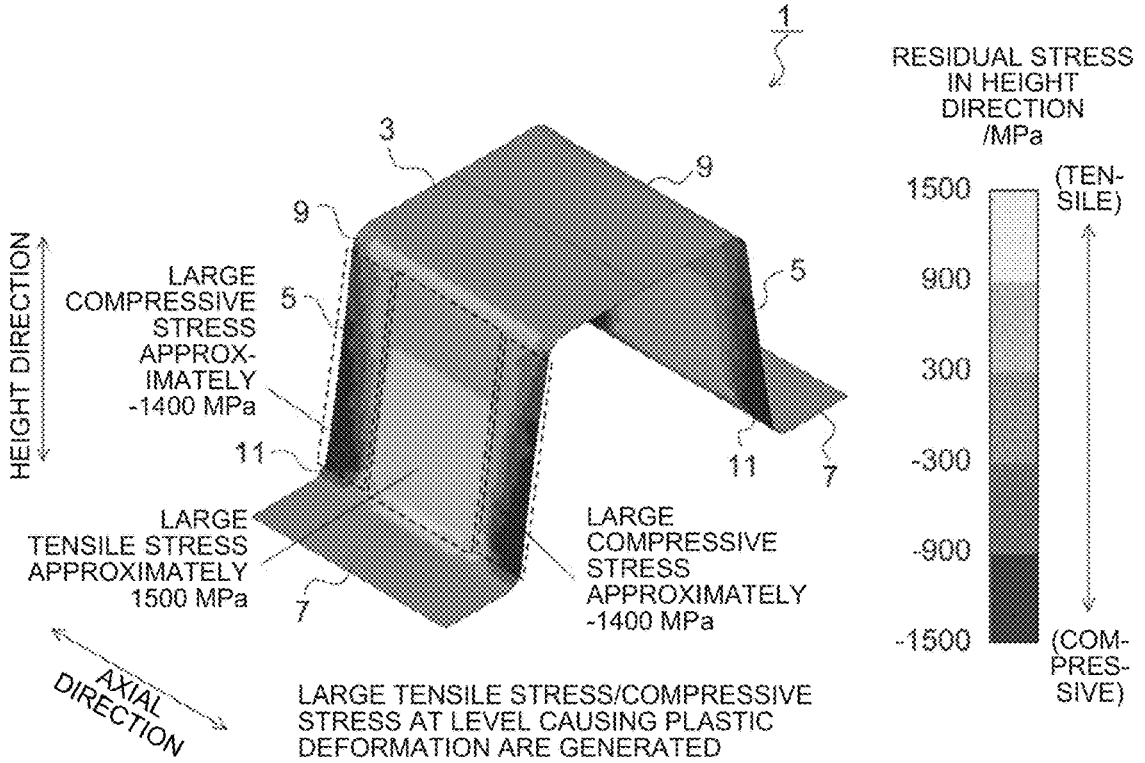
FIG. 10 is a diagram illustrating a distribution of residual stress in a height direction generated in a side wall portion of a press-formed product having a target shape press-formed by another aspect of the press forming method according to the embodiment of the present invention.

FIG. 10 illustrates a distribution of residual stress in the height direction of the press-formed product 1 in the forming bottom dead center in the second forming step. Unlike the case of the preformed part 31 including the concave curved flange portion 35 explained above (FIG. 7), when the preformed part 41 is press-formed into the press-formed product 1, a tensile stress is generated in the axial direction center where the side wall height of the side wall portion 5 is low and compressive stress is generated as a counterforce to the tensile stress on both the sides in the axial direction. Both of the tensile stress and the compressive stress generated in the side wall portion 5 as explained above have magnitude that exceeds the yield strength (=880 MPa) of the metal sheet to cause plastic deformation. Consequently, even when the flange portion 45 of the preformed part 41 is formed in a convexly curved shape, it is possible to reduce the residual stress difference between the front and rear surfaces in the side wall portion 5 and suppress wall camber.

Figure 11:
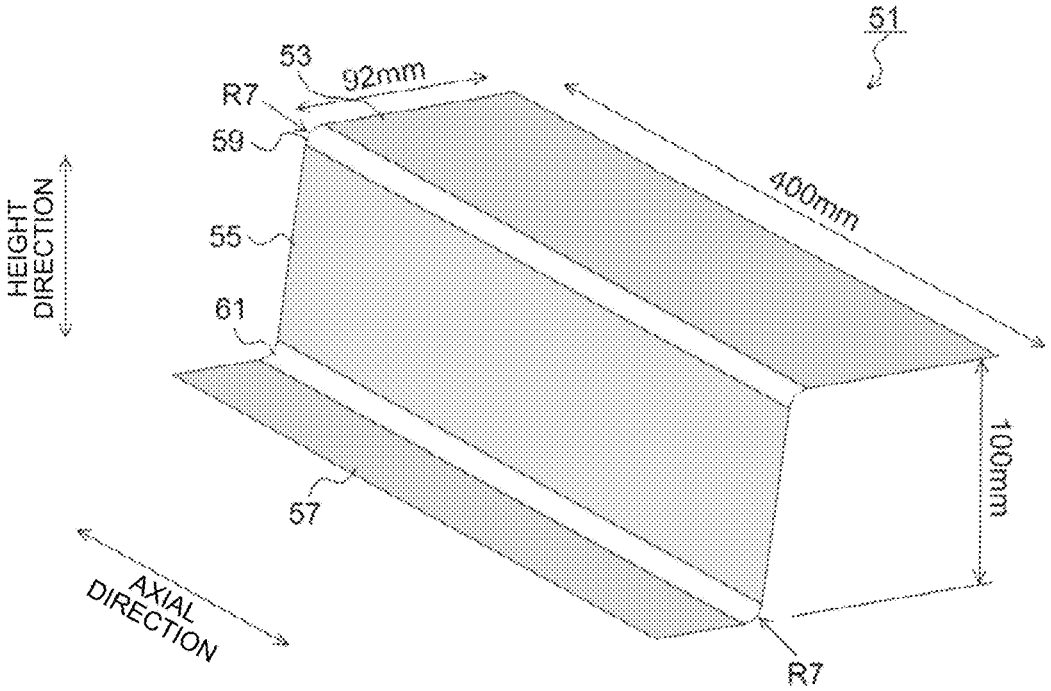
FIG. 11 is a diagram illustrating a press-formed product having a Z-type cross-sectional shape set as a forming target in a specific example of the press forming method according to the present invention and an example 2.

The present invention is not limited to press-forming the press-formed product 1 having the hat-type cross-sectional shape illustrated in FIG. 2 and may be press-forming a press-formed product 51 having a Z-type cross-sectional shape including a top portion 53, a side wall portion 55, and a flange portion 57 as illustrated in FIG. 11 as an example.

Figure 12:
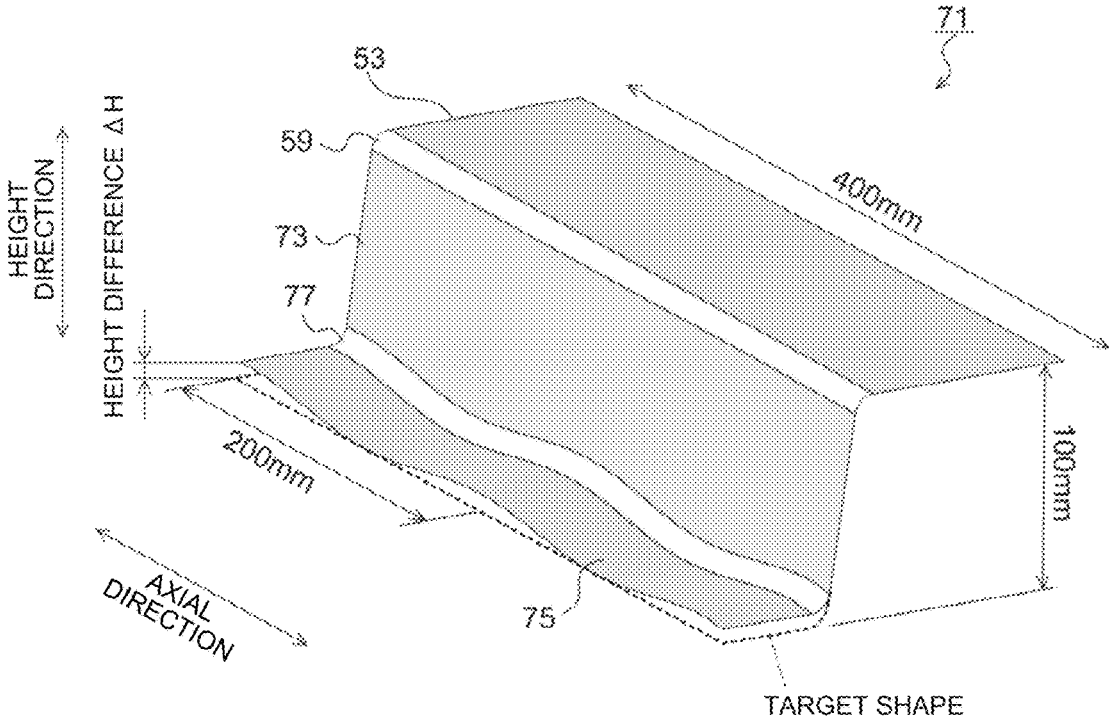
FIG. 12 is a diagram illustrating a specific example of the press forming method according to the present invention and a preformed part in the example 2.

Further, the flange portion of the preformed part press-formed in the first forming step is not limited to a shape curved in a concave or convex shape over the entire length in the axial direction illustrated in FIG. 8. As illustrated in FIG. 12 as an example, the flange portion may be a flange portion 75 curved in a concavo-convex shape in the height direction more largely than the target shape in a shape obtained by combining a concavely curved shape and a convexly curved shape and having height continuously changed in the axial direction to provide a height difference. The height difference of the flange portion 75 curved in the concavo-convex shape is a difference in the height direction between the highest position in a part curved in the convex shape and the lowest position in a part curved in a concave shape.

Then, in the second forming step, by forming the flange portion 75 into the flange portion 57 having the target shape to reduce the height difference of the flange portion 57 curved in the concavo-convex shape, it is possible to reduce the residual stress difference between the front and rear surfaces by applying the tensile stress and the compressive stress for causing plastic deformation to the side wall portion 55 and suppress wall camber of the side wall portion 55 due to springback.

As explained above, when the flange portion curved in the concave shape, the convex shape, or the concavo-convex shape is formed in the first forming step, the curvature of the curve (see a curvature ρ in FIG. 8) is desirably larger than 0 and smaller than 0.5. When the curvature of the curve is 0, that is, in the case of a flat shape, tensile stress and compressive stress for causing plastic deformation cannot be applied to the side wall portion in the second forming step. Therefore, wall camber cannot be prevented. When the curvature of the curve is 0.5 or more, since a curvature radius becomes too small, it is likely that unbending resistance for forming the flange portion into a flange portion having the target shape in the second forming step increases and fracture easily occurs, or the tool of press forming itself cannot withstand the unbending resistance and is deformed.

Figure 13:
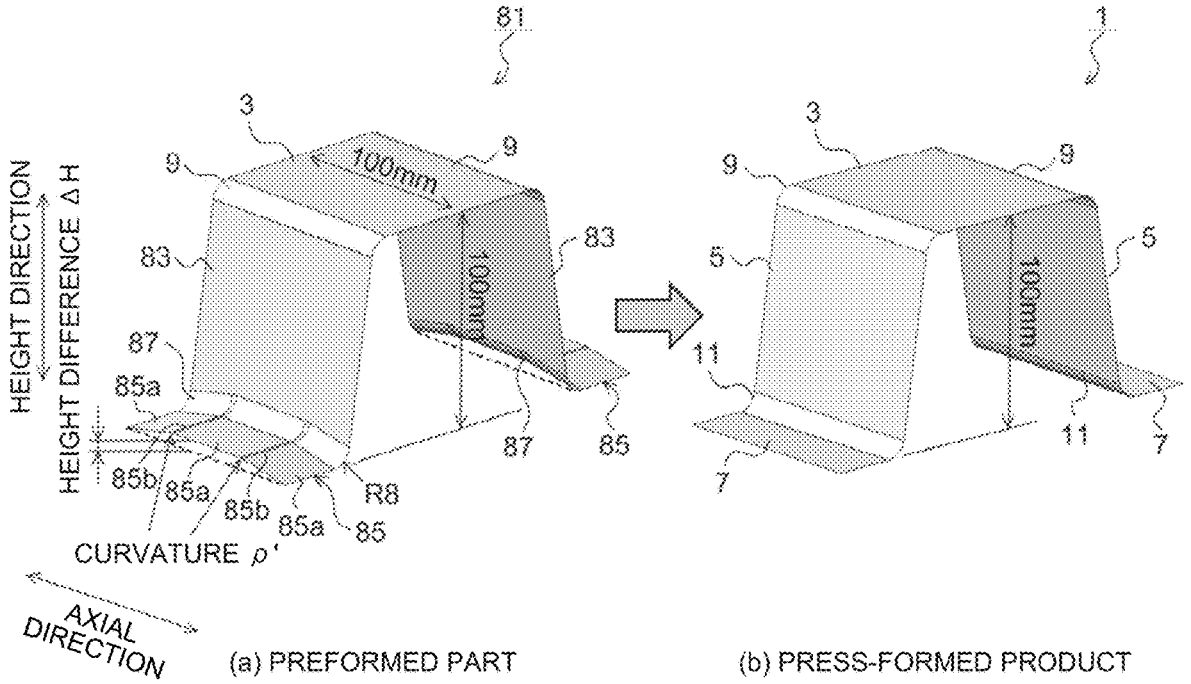
FIG. 13 is a diagram illustrating a specific example of the press forming method according to the present invention and a preformed part in an example 3 and a press-formed product having a target shape.

The flange portion press-formed in the first forming step is not limited to the shape curved in the concave shape, the convex shape, or the concavo-convex shape as described above. As illustrated in FIG. 13, a flange portion 85 may be the flange portion 85 having height continuously changed in the axial direction to have a convex shape more largely than the flange portion 7 having the target shape in the height direction by a plurality of planer portions 85*a* disposed in the axial direction and a bent portions 85*b* for coupling the planer portions 85*a* adjacent to each other to provide a height difference. Here, the height difference of the flange portion 85 is a difference in the height direction between the highest position and the lowest position in the height direction of the flange portion 85.

Then, in the second forming step, a preformed part 81 is press-formed into the press-formed product 1 having the target shape to reduce the height difference of the flange portion 85. Consequently, it is possible to generate tensile stress and compressive stress for causing plastic deformation in the side wall portion 5 and suppress wall camber of the side wall portion 5.

Note that the flange portion formed from the plurality of planer portions and the bent portions may be, for example, a flange portion (not illustrated) having height continuously changed in the axial direction to be concave in the height direction to provide a height difference besides the flange portion 85 convex in the height direction as illustrated in FIG. 13. The curvature of the bent portion (the curvature ρ' in FIG. 13) is desirably larger than 0 and smaller than 0.5 as in the curved flange portion explained above.

Further, in the above explanation, the flat flange portion 7 is formed in the second forming step as illustrated in FIG. 1. However, the flange portion having the target shape formed in the second forming step is not limited to the flat shape such as the shape curved in the concave or convex shape in the height direction in the axial direction.

Even in this case, by forming the flange portion having the target shape to reduce the height difference of the flange portion of the preformed part in the second forming step, tensile stress for causing plastic deformation and compressive stress as a counterforce of the tensile stress are generated in the side wall portion. Consequently, it is possible to reduce the residual stress difference between the front and rear surfaces of the side wall portion and suppress wall camber of the side wall portion due to springback of the press-formed product.

Note that the press forming method according to the present invention is not particularly limited in shapes and types of a metal sheet provided as a blank and a press-formed product but is more effective for automotive parts press-formed using a metal sheet having high residual stress after press-forming.

Specifically, the blank is preferably a metal sheet having tensile strength of a 440 MPa-grade or more and a 1800 MPa-grade or less and plate thickness of 0.5 mm or more and 4.0 mm or less.

With the metal sheet having tensile strength of less than 440 MPa, residual stress generated in the press-formed product is small and deterioration in dimensional accuracy due to wall camber relatively less easily occurs. Therefore, the advantage of using the present invention decreases.

However, a component having low component stiffness such as an automotive outer panel or a component having large height such as a wheelhouse inner is susceptible to a shape change due to a wall camber of a side wall portion. Therefore, it is desirable to use the present invention even for a metal sheet having tensile strength of less than 440 MPa.

On the other hand, although there is no particular upper limit of the tensile strength, a metal sheet having tensile strength exceeding 1800 MPa has poor ductility. Therefore, fracture easily occurs in a punch shoulder ridge and a die shoulder ridge in the press forming process and press forming sometimes cannot be performed.

Further, as a type of the press-formed product, for example, the present invention can be preferably applied to automotive parts such as outer panel parts such as a door, a roof, and a hood having low stiffness and frame parts such as an A pillar, a B pillar, a roof rail, a side rail, a front side member, a rear side member, and a cross member for which a high-strength metal sheet is used.

The first forming step and the second forming step of the press forming method according to the present invention may be either deep drawing or crash forming. However, the second forming step is preferably the crash forming. Since wall camber is less likely to occur in the crash forming than in the deep drawing, it is possible to suppress new wall camber from occurring in the side wall portion formed in the second forming step.

When the automotive parts or the like are manufactured by the press forming, a step of press-forming a preformed part in a first step and thereafter restriking the preformed part into a press-formed product having a product shape is often performed.

This is preferable because, by setting the second forming step according to the present invention as a step of restriking into a press-formed product having a product shape, it is possible to obtain, without increasing the number of steps, a press-formed product having a product shape in which wall camber of a side wall portion is suppressed.

The first forming step and the second forming step do not need to be continuously performed. A trim cutting step for cutting the preformed part, a forming step for applying other machining, or the like may be interposed between the first forming step and the second forming step. Further, the present invention may be applied to a press-formed product having a U-type cross-sectional shape or an L-type cross-sectional shape not having a flange portion. In this case, it is necessary to trim, in a later step, the flange portion of the press-formed product having the hat-type cross-sectional shape or the Z-type cross-sectional shape formed in the second forming step. Therefore, a yield decreases, but it is possible to suppress wall camber of the side wall portion due to springback.

Example 1

In an example 1, the press-formed product 1 having the hat-type cross-sectional shape illustrated in FIG. 2 was press-formed by the press forming method according to the present invention and the effect of suppressing wall camber of the side wall portion 5 was verified.

The press-formed product 1 to be formed has the hat-type cross-sectional shape including the top portion 3, the side wall portion 5, and the flange portion 7. In the press-formed product 1, an axial direction length was set to 100 mm, height was set to 100 mm, width of the top portion was set to 85 mm, width of the flange portion was set to 30 mm, and both of curvature radiuses of the punch shoulder ridge 9 and the die shoulder ridge 11 were set to 9 mm.

Then, using a cold-rolled steel sheet having mechanical properties shown in the following Table 1 as a metal sheet, the press-formed product 1 was press-formed by the first forming step and the second forming step of the press forming method according to the present invention.

TABLE 1

| Sheet thickness/mm | Yield strength/MPa | Tensile strength/MPa | Elongation/% |
|---|---|---|---|
| 1.6 | 880 | 1210 | 13 |

First, in the first forming step, a preformed part was press-formed by deep drawing and, in the subsequent second forming step, the preformed part was press-formed into a press-formed product having a target shape while a top portion was pressed with a pad by crash forming. Here, a blank holder force of the deep drawing in the first forming step was set to 5 tonf and a pad holding force of the pad in the second forming step was set to 3 tonf. Then, an amount of wall camber of the side wall portion 5 was evaluated by measuring a curvature of the side wall portion 5 in the side wall height direction after the press-formed product 1 was die-released from the tool of press forming and subjected to springback.

In the example 1, as an invention example 1 to an invention example 8, the shape and the height difference of the flange portion of the preformed part in the first forming step were changed as shown in Table 2.

The shape of the flange portion of the preformed part was set to a shape concavely or convexly curved in the height direction in the axial direction. The height difference of the flange portion was set to a difference between heights of the axial direction center and the axial direction tip.

The flange portion of the press-formed product having the target shape in the second forming step was set to a flat shape (having a curvature of 0 $mm^{-1}$) or a concavely curved shape (having a curvature of 0.00125 $mm^{-1}$). Even when the flange portion having the target shape is formed in a curved shape, the flange portion of the preformed part was formed in a shape further curved in the height direction than the target shape, that is, the height difference of the flange portion of the preformed part was set larger than the height difference of the flange portion having the target shape.

As comparison target, a press-formed product press-formed with a tool of press forming having a target shape in one step by deep drawing, a press-formed product press-formed in one step by providing a bead (not illustrated) on a flange portion by the deep drawing as in Patent Literature 1 described above, and a preformed part having a side wall height lower than that of the target shape by the deep drawing as in FIG. 5 referred to above were press-formed. Subsequently, the amount of wall camber of the side wall portion was also evaluated for the press-formed product obtained by press-forming the preformed part to the side wall height of the target shape by crash forming. The amount of wall camber of the side wall portion was set as a curvature of wall camber from a side wall end of a punch shoulder R portion extending from the top portion to the side wall portion to a side wall tip of the die shoulder R portion extending from the side wall portion to the flange portion.

Note that, in the press forming of the press-formed product set as the comparison target, a blank holder force in the deep drawing and a pad holding force in the crash forming were set to the same conditions as in the invention examples explained above. Table 2 shows results of the evaluated wall camber amounts of the side wall portion.

TABLE 2

| | Shape of flange portion of preformed part | Height difference of flange portion/mm: First forming step (Preformed part) | Height difference of flange portion/mm: Second forming step (Target shape) | Curvature ρ of flange portion/mm$^{-1}$: First forming step (Preformed part) | Curvature ρ of flange portion/mm$^{-1}$: Second forming step (Target shape) | Wall camber amount of side wall portion/mm$^{-1}$: Axial direction center | Wall camber amount of side wall portion/mm$^{-1}$: Axial direction tip |
|---|---|---|---|---|---|---|---|
| Comparative example 1 | | 0 | — | 0 | — | 0.0172 | 0.0168 |
| Comparative example 2 | | 0 | — | 0 | — | 0.0101 | — |
| Comparative example 3 | | 0 | 0 | 0 | 0 | 0.0165 | 0.0154 |
| Invention example 1 | Concave curved | 1.6 | 0 | 0.00125 | 0 | 0.0120 | 0.0118 |
| Invention example 2 | Concave curved | 3.1 | 0 | 0.00250 | 0 | 0.0099 | 0.0092 |
| Invention example 3 | Concave curved | 6.4 | 0 | 0.00500 | 0 | 0.0072 | 0.0057 |
| Invention example 4 | Convex curved | 1.6 | 0 | 0.00125 | 0 | 0.0129 | 0.0127 |
| Invention example 5 | Convex curved | 3.1 | 0 | 0.00250 | 0 | 0.0103 | 0.0107 |
| Invention example 6 | Convex curved | 6.4 | 0 | 0.00500 | 0 | 0.0065 | 0.0090 |
| Comparative example 4 | Concave curved | 1.6 | — | 0.00125 | — | 0.0165 | 0.0161 |
| Invention example 7 | Concave curved | 3.1 | 1.6 | 0.00250 | 0.00125 | 0.0110 | 0.0106 |
| Comparative example 5 | Convex curved | 1.6 | — | 0.00125 | — | 0.0167 | 0.0158 |
| Invention example 8 | Convex curved | 6.4 | 1.6 | 0.00500 | 0.00125 | 0.0090 | 0.0110 |

In Table 2, in a comparative example 1 to a comparative example 3 and the invention example 1 to the invention example 6, the flange portion of the press-formed product having the target shape was formed in a flat shape.

In the comparative example 1, the press-formed product 1 was press-formed with a tool of press forming having the target shape in one step by deep drawing. An amount of wall camber of the side wall portion 5 in the comparative example 1 was 0.0172 mm$^{-1}$ in the axial direction center and was 0.0168 mm$^{-1}$ at the axial direction tip, and wall camber occurred.

In the comparative example 2, the press-formed product 1 deep-drawn by providing a bead in the flange portion was press-formed. The amount of wall camber of the side wall portion 5 in the comparative example 2 was 0.0101 mm$^{-1}$ in the axial direction center, which was smaller than that in the comparative example 1. However, at the axial direction tip, a localizer neck (shape defects in which tensile stress exceeding yield stress of a metal sheet is applied and a plate thickness is locally reduced) occurred near the boundary between the punch shoulder ridge 9 and the side wall portion 5, resulting in forming failure.

In the comparative example 3, the preformed part 21 lower than the press-formed product 1 having the target shape was formed by the deep drawing and, subsequently, the press-formed product 1 was press-formed with the tool of press forming having the target shape by crash forming (see FIG. 5). The amount of wall camber of the side wall portion 5 in the comparative example 3 was 0.0165 mm$^{-1}$ in the axial direction center and was 0.0154 mm$^{-1}$ at the axial direction tip, both of which were smaller those in the comparative example 1. However, the effect of suppressing wall camber was small.

In the invention example 1 to the invention example 3, as illustrated in FIG. 8(*a*), the flange portion 35 of the preformed part 31 was formed in a concavely curved shape over the entire axial direction length and the height difference of the flange portion 35 was changed by changing the curvature ρ of the curve. In the invention example 1 to the invention example 3, the amount of wall camber of the side wall portion 5 was reduced both in the axial direction center and at the axial direction tip compared with the comparative example 1 and the comparative example 3. The wall camber suppressing effect was obtained. Further, when the invention example 1 and the invention example 3 are compared, by increasing the curvature of the curve of the flange portion 35 (increasing the height difference), the amount of wall camber was reduced and the wall camber was able to be further suppressed.

In the invention example 4 to the invention example 6, as illustrated in FIG. 8(*b*), the flange portion 45 of the preformed part 41 was formed in a convexly curved shape over the axial direction entire length and the height difference of the flange portion 45 was changed by changing the curvature ρ of the curve. In the invention example 4 to the invention example 6, the amount of wall camber of the side wall portion 5 was reduced both in the axial direction center and at the axial direction tip compared with the comparative example 1 and the comparative example 3. The wall camber suppressing effect was obtained as in the invention example 1 to the invention example 3. Further, when the invention example 4 to the invention example 6 are compared, by increasing the curvature of the flange portion 45 (increasing the height difference), the amount of wall camber of the side wall portion 5 was reduced and the wall camber was able to be further suppressed.

In a comparative example 4 and the invention example 7, a press-formed product having a flange portion curved in a concave shape in the axial direction was press-formed. In the comparative example 4, the height difference of the flange portion having the target shape was set to 1.6 mm in one step by the deep drawing. The amount of wall camber of the side wall portion of the press-formed product in the comparative example 4 was 0.0165 $mm^{-1}$ in the axial direction center and was 0.0161 $mm^{-1}$ at the axial direction tip. In contrast, the amount of wall camber of the side wall portion of the press-formed product in the invention example 7 in which the height difference of the flange portion was 3.1 mm in the first forming step and was 1.6 mm in the second forming step was 0.0110 $mm^{-1}$ in the axial direction center and was 0.0106 $mm^{-1}$ at the axial direction tip, both of which were smaller than those in the comparative example 4. The wall camber suppressing effect was obtained.

In a comparative example 5 and the invention example 8, a press-formed product having a flange portion curved in a convex shape in the axial direction was press-formed. In the comparative example 5, the height difference of the flange portion having the target shape was set to 1.6 mm in one step by the deep drawing. The amount of wall camber of the side wall portion in the comparative example 5 was 0.0167 $mm^{-1}$ in the axial direction center and was 0.0158 $mm^{-1}$ at the axial direction tip. In contrast, the wall camber amount of the side wall portion in the invention example 8 in which the height difference of the flange portion was set to 6.4 mm in the first forming step and was set to 1.6 mm in the second forming step was 0.0090 $mm^{-1}$ in the axial direction center and was 0.0110 $mm^{-1}$ at the axial direction tip, both of which were smaller than those in the comparative example 5. The wall camber suppressing effect was obtained.

Example 2

In an example 2, the press-formed product 51 having a Z-type cross-sectional shape illustrated in FIG. 11 was press-formed by the press forming method according to the present invention and the effect of suppressing wall camber of the side wall portion 55 was verified.

The press-formed product 51 to be formed was formed in a Z-type cross-sectional shape including the top portion 53, the side wall portion 55, and the flange portion 57, and the length of the press-formed product 51 in the axial direction was set to 400 mm, the height was set to 100 mm, the width of the top portion 53 was set to 92 mm, and both of the curvature radiuses of a punch shoulder ridge 59 and a die shoulder ridge 61 were set to R7 mm. The press-formed product 51 was press-formed by the first forming step and the second forming step of the press forming method according to the present invention using a zinc-coated steel sheet having mechanical properties shown in the following Table 3 as a metal sheet.

TABLE 3

| Sheet thickness/mm | Yield strength/MPa | Tensile strength/MPa | Elongation/% |
|---|---|---|---|
| 1.2 | 305 | 445 | 16 |

A preformed part 71 illustrated in FIG. 12 was press-formed in the first forming step and, subsequently, the preformed part 71 was press-formed into the press-formed product 51 while the top portion 53 was pressed with a pad in the second forming step. Here, both of the first forming step and the second forming step were crash forming and a pad holding force by the pad was set to 10 tonf.

Then, a curvature of the side wall portion 55 in the side wall height direction after the press-formed product 51 was die-released from the tool of press forming and subjected to springback was measured and the amount of wall camber of the side wall portion 55 was evaluated. The amount of wall camber was measured by the same method as the method in the example 1.

In the example 2, the flange portion 75 of the preformed part 71 was formed in a shape curved in a concavo-convex shape (a sine curve shape in a side view at a period of 200 mm in the axial direction) and the height difference of the flange portion 75 was changed. The shape of the flange portion 57 of the press-formed product 51 having the target shape was set flat.

Then, as a comparative example 6, the amount of wall camber of the side wall portion 55 was evaluated for the press-formed product 51 press-formed with the tool of press forming having the target shape in one step by the deep drawing. Here, a blank holder force in the deep drawing was set to 5 tonf. Table 4 shows results of the evaluated amount of wall camber of the side wall portion 55.

TABLE 4

| | Height difference of flange portion/mm | | Wall camber amount of side wall portion/$mm^{-1}$ | |
|---|---|---|---|---|
| | First forming step | Second forming step | Axial direction center | Axial direction tip |
| Comparative example 6 | 0 | — | 0.0102 | 0.0114 |
| Invention example 9 | 4 | 0 | 0.0081 | 0.0093 |
| Invention example 10 | 8 | 0 | 0.0075 | 0.0087 |
| Invention example 11 | 12 | 0 | 0.0072 | 0.0052 |

The amount of wall camber of the side wall portion 55 in the comparative example 6 was 0.0102 $mm^{-1}$ in the axial direction center and was 0.0114 $mm^{-1}$ at the axial direction tip and wall camber occurred.

In invention examples 9 to 11, the amount of wall camber of the side wall portion 55 was reduced both in the axial direction center and at the axial direction tip compared with the comparative example 6. The wall camber suppressing effect was obtained. Further, when the invention example 9 to the invention example 11 are compared, by increasing the height difference of the flange portion 75 of the preformed part 71, the amount of wall camber of the side wall portion 55 was reduced and the wall camber was able to be further suppressed.

Example 3

In an example 3, the press-formed product 1 having the hat-type cross-sectional shape illustrated in FIG. 2(*a*) was press-formed by the press forming method according to the present invention. The effect of suppressing wall camber of the side wall portion 5 was verified.

The dimensions of the press-formed product 1 to be formed and the metal sheet served for press-forming were the same as those in the example 1 explained above. The press-formed product 1 was press-formed by the first forming step and the second forming step of the press forming method according to the present invention. Here, a blank holder force in the deep drawing in the first forming step was set to 5 tonf and a pad holding force of the pad in the crash forming in the second forming step was set to 3 tonf.

In the first forming step, as illustrated in FIG. 13(*a*), the preformed part 81 including the flange portion 85, the height of which changes to be convex in the height direction in the axial direction with the planer portion 85*a* and the bent portion 85*b* was press-formed by deep drawing. Then, in the subsequent second forming step, the flat flange portion 7 was formed by crash forming step. Table 5 shows results of an evaluated wall camber amount of the side wall portion. The amount of wall camber was measured by the same method as the method in the example 1.

TABLE 5

| | Height difference of flange portion/mm | | Curvature ρ' of the bent portion/mm$^{-1}$ | | Wall camber amount of side wall portion/mm$^{-1}$ | |
|---|---|---|---|---|---|---|
| | First forming step | Second forming step | First forming step | Second forming step | Axial direction center | Axial direction tip |
| Invention example 12 | 10 | 0 | 0.020 | 0 | 0.0102 | 0.0113 |
| Invention example 13 | 10 | 0 | 0.2000 | 0 | 0.0082 | 0.0089 |
| Invention example 14 | 5 | 0 | 0.4000 | 0 | 0.0071 | 0.0078 |
| Reference example 1 | 5 | 0 | 0.5000 | 0 | — | — |

In an invention example 12 and an invention example 13, the height difference of the flange portion 85 was set to 10 mm and the curvature of the bent portion 85*b* was changed. When the invention example 12 and the invention example 13 are compared, it is seen that, by increasing the curvature of the bent portion 85*b*, the amount of wall camber of the side wall portion 5 is reduced both in the axial direction center and at the axial direction tip and the wall camber can be further suppressed.

In an invention example 14, compared with the invention example 12 and the invention example 13, the height difference of the flange portion 85 was reduced and the curvature of the bent portion 85*b* was increased. The amount of wall camber of the side wall portion 5 in the invention example 14 was 0.0071 mm$^{-1}$ in the axial direction center and was 0.0078 mm$^{-1}$ at the axial direction tip and the amount of wall camber was reduced compared with the invention example 12 and the invention example 13 and the wall camber was able to be further suppressed.

In a reference example 1, the curvature of the bent portion 85*b* was increased to 0.5 mm$^{-1}$ compared with the invention example 14. In the reference example 1, in the first forming step for press-forming the preformed part 81, fracture occurred near the die shoulder ridge 87 and the press-formed product 1 was not able to be press-formed.

INDUSTRIAL APPLICABILITY

According to the present invention, it is possible to provide a press forming method for suppressing fracture in a press forming process and suppressing wall camber of a side wall portion without lowering a yield.

REFERENCE SIGNS LIST

1 PRESS-FORMED PRODUCT
3 TOP PORTION
5 SIDE WALL PORTION
7 FLANGE PORTION
9 PUNCH SHOULDER RIDGE
11 DIE SHOULDER RIDGE
21 PREFORMED PART
23 SIDE WALL PORTION
25 FLANGE PORTION
27 DIE SHOULDER RIDGE
31 PREFORMED PART
33 SIDE WALL PORTION
35 FLANGE PORTION
37 DIE SHOULDER RIDGE
41 PREFORMED PART
43 SIDE WALL PORTION
45 FLANGE PORTION
47 DIE SHOULDER RIDGE
51 PRESS-FORMED PRODUCT
53 TOP PORTION
55 SIDE WALL PORTION
57 FLANGE PORTION
59 PUNCH SHOULDER RIDGE
61 DIE SHOULDER RIDGE
71 PREFORMED PART
73 SIDE WALL PORTION
75 FLANGE PORTION
77 DIE SHOULDER RIDGE
81 PREFORMED PART
83 SIDE WALL PORTION
85 FLANGE PORTION
85*a* PLANER PORTION
85*b* BENT PORTION
87 DIE SHOULDER RIDGE

The invention claimed is:

1. A press forming method for suppressing wall camber of a side wall portion due to springback of a press-formed product including a top portion, the side wall portion and a flange portion, the press forming method comprising:

a first forming step of press-forming a preformed part to include a preformed part top portion, a preformed part side wall portion, a performed part punch shoulder ridge that connects the performed part top portion and the preformed part side wall portion, and a preformed part flange portion, the preformed part flange portion having:

a height in a height direction continuously changing along an axial direction;

a concave shape, a convex shape or a concavo-convex shape; and a height in the height direction that changes more along the axial direction than a height of a target shape of the flange portion of the press-formed product, a second forming step of press-forming the preformed part into the press-formed product having the target shape to reduce a height difference of the preformed part flange portion, wherein the preformed part top portion and the preformed part punch shoulder ridge formed in the first forming step have a respective same shape as the target shape of the top portion and a punch shoulder ridge that connects the top portion and the side wall portion of the press-formed product.

2. The press forming method according to claim 1, wherein the preformed part flange portion in the first forming step has a shape curved in the convex shape or the concave shape in the height direction in the axial direction.

3. The press forming method according to claim 1, wherein the preformed part flange portion in the first forming step is formed in the convex shape or the concave shape in the height direction in the axial direction by a plurality of planer portions disposed in the axial direction and a bent portion coupling the adjacent planer portions.

4. The press forming method according to claim 1, wherein a blank to be subjected to the press-forming of the press-formed product is a metal sheet having tensile strength of a 440 MPa-grade to a 1800 MPa-grade.

5. The press forming method according to claim 2, wherein a blank to be subjected to the press-forming of the press-formed product is a metal sheet having tensile strength of a 440 MPa-grade to a 1800 MPa-grade.

6. The press forming method according to claim 3, wherein a blank to be subjected to the press-forming of the press-formed product is a metal sheet having tensile strength of a 440 MPa-grade to a 1800 MPa-grade.

* * * * *